US011278907B2

(12) United States Patent
Scharfe

(10) Patent No.: US 11,278,907 B2
(45) Date of Patent: Mar. 22, 2022

(54) COMMINUTION DEVICE

(71) Applicant: PMS Handelskontor GmbH, Hamburg (DE)

(72) Inventor: Oscar Scharfe, Hamburg (DE)

(73) Assignee: PMS Handelskontor GmbH, Hamburg (DE)

( * ) Notice: Subject to any disclaimer, the term of this patent is extended or adjusted under 35 U.S.C. 154(b) by 997 days.

(21) Appl. No.: 15/528,577

(22) PCT Filed: Nov. 23, 2015

(86) PCT No.: PCT/DE2015/100497
§ 371 (c)(1),
(2) Date: May 22, 2017

(87) PCT Pub. No.: WO2016/131433
PCT Pub. Date: Aug. 25, 2016

(65) Prior Publication Data

US 2018/0339297 A1 Nov. 29, 2018

(30) Foreign Application Priority Data

Feb. 18, 2015 (DE) ..... 10 2015 102 326.1

(51) Int. Cl.
*B02C 13/18* (2006.01)
*B02C 13/288* (2006.01)
(Continued)

(52) U.S. Cl.
CPC ..... *B02C 13/18* (2013.01); *B02C 13/14* (2013.01); *B02C 13/282* (2013.01);
(Continued)

(58) Field of Classification Search
CPC ..... B02C 13/26; B02C 13/31; B02C 13/14; B02C 13/18; B02C 13/282; B02C 13/286;
(Continued)

(56) References Cited

U.S. PATENT DOCUMENTS 2,609,993 A * 9/1952 Planiol ..... B02C 13/1835 241/67
3,076,487 A * 2/1963 Illsley ..... B02C 18/0092 241/101.4
(Continued)

FOREIGN PATENT DOCUMENTS

CN 2114509 U 9/1992
CN 1076640 A 9/1993
(Continued)

OTHER PUBLICATIONS

Directive 2006/42/EC of the EP Parliament & of the Council of May 17, 2006 on machinery . . . , Off. Journal of EP Union, Jun. 9, 2006, L157, pp. 24-86.

*Primary Examiner* — Jessica Cahill
*Assistant Examiner* — Jared O Brown
(74) *Attorney, Agent, or Firm* — Welsh Flaxman & Gitler LLC

(57) ABSTRACT

The invention relates to a device (10; 50) for mechanically comminuting materials, including a vertically extending comminuting chamber (14) having an upwardly extending supply side (15) and a downwardly extending discharge side. The comminuting chamber is enclosed by an circular cylindrical and/or conical downwardly expanded comminuting chamber wall (12), and in which at least one rotor (16, 18) rotating about a vertical rotor axis (R) is arranged, which is provided with striking tools (38) that extend radially into the comminuting chamber, at least during operation. The rotors (16, 18) are held in a stationary manner with respect to a support base (20) of the device, and the comminuting chamber wall is supported on the support base. According to the invention, the comminuting chamber wall is held in place by way of a lifting device in the direction of the rotor axis (R) in a height adjustable manner relative to the support base (20). The lifting device (36) has a working position, in
(Continued)

which the lower edge of the comminuting chamber wall (12) is arranged close to the support base (20) or to a part connected thereto, and a maintenance position, in which the lower edge (32) of the comminuting chamber wall (12) is vertically raised above at least one of the striking tools (22, 24). The invention allows easy maintenance and an uncomplicated exchange of the striking tools of the comminuting device.

15 Claims, 3 Drawing Sheets

(51) Int. Cl.
*B02C 13/31* (2006.01)
*B02C 13/282* (2006.01)
*B02C 13/14* (2006.01)
*B02C 13/286* (2006.01)

(52) U.S. Cl.
CPC ..... *B02C 13/288* (2013.01); *B02C 13/31* (2013.01); *B02C 2013/28609* (2013.01); *B02C 2013/28672* (2013.01)

(58) Field of Classification Search
CPC ..... B02C 13/288; B02C 2013/28609; B02C 2013/28672
USPC ..... 241/285.1, 285.2, 285.3
See application file for complete search history.

(56) References Cited

U.S. PATENT DOCUMENTS 3,561,072 A * 2/1971 Oster ..... B02C 13/18 241/185.5
4,077,574 A 3/1978 Francis
4,575,014 A 3/1986 Szalanski et al.
5,947,396 A 9/1999 Pierce
6,227,472 B1 * 5/2001 Ryan ..... B02C 13/1807 241/275
6,585,178 B1 * 7/2003 Kraemer ..... B02C 13/14 241/285.2
2010/0163657 A1 * 7/2010 Lehtonen ..... B02C 2/10 241/30
2014/0077010 A1 * 3/2014 Watts ..... B02C 13/14 241/55

FOREIGN PATENT DOCUMENTS

CN 2312757 Y 4/1999
CN 1678399 A 10/2005
CN 201012332 Y 1/2008
DE 1284818 A 12/1968
DE 8810234 9/1988
DE 4005555 A1 8/1991
DE 4319702 12/1994
DE 19603627 A1 8/1997
DE 20215158 9/2003
DE 102005029899 A1 1/2007
DE 102012104031 A1 11/2013
EP 0562194 9/1993
EP 0702598 B1 2/1997
JP H06402 A 1/1994
JP 06063431 A * 3/1994
JP H0663431 A 3/1994
JP 2013132631 A 7/2013
RU 2271866 C1 3/2006
WO WO-9429027 A1 * 12/1994 ..... B02C 13/1814
WO WO-2013167398 A1 * 11/2013 ..... B02C 13/16

* cited by examiner

COMMINUTION DEVICE

BACKGROUND OF THE INVENTION

The invention relates to a comminution device or crushing device for the mechanical crushing of materials, specifically material conglomerates made of different materials. The comminution device includes a vertical crushing chamber with an infeed side pointing vertically upwards and an outlet side pointing vertically downwards. The crushing chamber is enclosed by a circular cylindrical and/or conically flared crushing chamber wall. The crushing chamber features at least one, preferably two, successive sections arranged in axial direction, wherein at least one rotor each is arranged rotatably about a vertical rotation axis R and coaxially to the crushing chamber. The rotor carries the striking tools which at least during operation are projecting at least mainly radially into the crushing chamber, e.g. impact rods or chains. The rotor is held in a fixed stationary position in relation to a supporting base of the crushing device, which supporting base also serves to support crushing chamber wall. Crushing devices of this type feature a vertical alignment of the crushing chamber, thus ensuring that the infeed side is pointing vertically upwards and that the outlet side is pointing vertically downwards. A problem arises during the maintenance of the striking tools which are subject to considerable wear and tear. Replacement requires cumbersome working under very confined conditions within the crushing chamber.

It is the aim of the invention to create a crushing device of the above-mentioned kind which will be easy to maintain.

SUMMARY OF THE INVENTION

According to the invention, the crushing chamber wall is held in axial direction R of the crushing device by a lifting device which is height-adjustable relative to the supporting base. The lifting device features a first working position wherein the bottom edge of the crushing chamber wall is arranged in close proximity either to the supporting base or to a part connected to it, and is notably in contact with the Supporting base, and a maintenance position wherein the bottom edge of the crushing chamber wall is lifted vertically above at least one of the striking tools of the crushing device.

This makes it possible to lay bare the striking tools of the rotor located in the center of the crushing chamber, which in turn makes it easy for the service engineer to perform repairs or to replace worn striking tools.

The entire crushing chamber wall is preferably kept height-adjustable by the lifting device. The lifting device allows the rotor to be accessed from all sides and significantly facilitates any maintenance and repair works.

The lifting device preferably contains at least one hydraulic cylinder which is on the one hand fixed stationary to the supporting base, preferably directly fixed to the supporting base, and which on the other hand engages with the cylinder chamber wall or an assembly part connected thereto. To ensure that the crushing chamber wall is lifted as evenly and centrically as possible, the lifting device preferably features between two and four at least predominantly vertical, possibly parallel hydraulic cylinders which in the most advantageous case are arranged equidistantly around a central (vertical) axis of the crushing device. In this way, the weight of the crushing chamber wall is distributed evenly over all hydraulic cylinders, which avoids uneven loads on the hydraulic cylinders and prevents the crushing chamber wall from twisting during lifting. The lifting device may be mounted e.g. to a carrier support which is stationarily fixed to the supporting base, e.g. arranged on the floor or a building or connected to the supporting base. Advantageously, however, the lifting device is arranged on and/or mounted to the supporting base, i.e. its bottom side connected to the supporting base, which has the advantage that the supporting base is carrying all essential components of the crushing device, thereby realizing the crushing device as an integrated configuration.

While in the raised maintenance position, at least one of the striking tools, but preferably all striking tools of the rotor and/or the rotors will be laid bare, which means that all striking tools of the crushing device will be easy to replace. While in the working position, the bottom edge of the crushing chamber wall is preferably in contact with the supporting base, resting on top or against it, thereby hermetically sealing off the crushing chamber towards the supporting base, while the outlet is in this case preferably arranged in the area of and/or in the supporting base.

Preferably, the crushing device has an electrical circuit breaker for its drive, which is in contact on the one hand with the supporting base and on the other hand with the separating chamber wall or with the contact elements stationarily connected to these elements. This way it will not be possible to start up the crushing device unless the lifting device is in the working position, which ensures that the striking tools will not be readily accessible when the crushing device is being turned on. The motor/motors for driving the rotor/rotors will not be able to start unless the circuit breaker is closed, which in turn is possible only if the lifting device is in the working position. This embodiment of the invention is therefore very safe for the workplace.

The crushing device preferably contains a speed detection device for the rotor/rotors which determines whether the rotors are turning or not. The speed detection device is capable of issuing an enabling signal while all rotors are at a standstill. In addition, the crushing device contains a safety circuit which shuts off the power supply to the drive of the lifting device until an enabling signal is issued. This kind of simple electrical device makes the operation of the lifting device safe in that it prevents the cylinders of the crushing chamber from lifting while the rotor is running. This measure also makes a significant contribution to increasing the operational safety of the crushing device. In combination with the disconnect switch, it guarantees 100% operational safety.

Preferably, the crushing chamber wall is a cylinder wall with a circular or polygonal footprint of the type typically used in crushing devices. This type of crushing chamber wall is easy to manufacture on the one hand and can be easily moved back and forth between the maintenance position and the working position by a lifting device back on the other hand.

In an advantageous further development of the invention, a loading cone connected to the crushing chamber wall is arranged at the infeed side. The loading cone interacts with a feed hopper which can be moved by the lifting device, either separately and/or in connection with the lifting of the crushing chamber wall. This way, the lifting device serves not only for the vertical movement of the cylinder chamber of the crushing chamber wall, it also serves to move the feed hopper in relation to the loading cone, which makes it possible to adjust the size of the infeed slot for the goods to be loaded, with the aid of the lifting device. This allows easy control of the operating conditions of the crushing device.

In an advantageous further development of the invention, an airflow device for conveying a mix of air and particles generated in the crushing chamber is arranged in connection with the crushing chamber. This airflow device features at least one fan rotor arranged coaxially to the axis of the crushing chamber, which fan rotor is powered by its own fan drive. This allows the fan rotor to rotate independently of the rotors of the crushing device. The fan rotor is located below the bottom edge of the crushing chamber wall while the crushing chamber wall has been raised up into the maintenance position by the lifting device. This also permits easy maintenance of the fan rotor of the airflow device.

Preferably, each rotor of the crushing device has a fastening device for releasable attachment of the striking tools, which allows easy replacement of the striking tools while the crushing chamber wall is in the raised position.

Preferably, a level distribution base is arranged at or in the supporting base at the outlet side of the crushing chamber. This makes it easy to provide containers at the supporting base for accommodating the various different types of materials, as a result of which the crushing device does not require any additional materials or particle guiding devices.

It is obvious to the person skilled in the art that the aforementioned embodiments of the invention can be combined with each other in virtually any manner, provided they are not technically at odds with each other.

BRIEF DESCRIPTION OF THE DRAWINGS

The invention is described in the following e.g. by the schematic drawings.

DETAILED DESCRIPTION OF THE INVENTION

Figure 1:
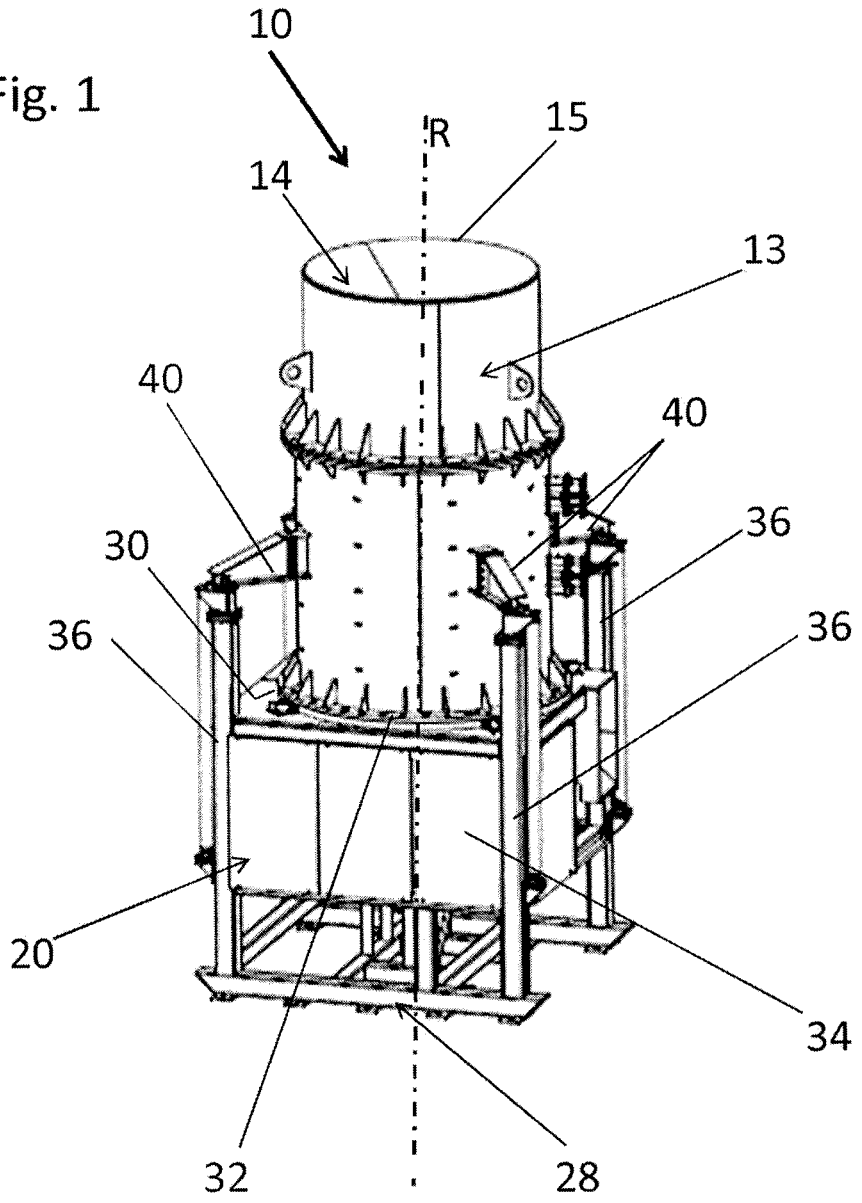
FIG. 1 shows a first embodiment of a crushing device with the lifting device in the working position.

The crushing device 10 contains a plain cylindrical crushing chamber wall 12 enveloping the crushing chamber 14, whose vertical central axis features two rotors 16, 18 (FIG. 2) which are preferably mounted on a supporting base 20 with its own drives (not shown). The rotors 16, 18 rotate around the vertical rotation axis R, which constitutes the axis of the crushing device. The crushing chamber 14 is arranged vertically and features an infeed side 15 on top and an outlet side facing the supporting base 20. The two rotors 16, 18, which are located in different axial segments of the crushing chamber 14, can therefore be actuated separately from each other, both in different directions of rotation and at different speeds. Each rotor 16, 18 features its own striking tools 22, 24, in the present case e.g. beater blades projecting radially into the crushing chamber 14. Instead of the metal beater blades shown herein, it is also possible to use chains or swivel-mounted beater rods for striking tools. The outlet side of the crushing chamber 14 features a fan rotor 26 which is arranged in the supporting base 20, below a feeder plate 30 fitted to the top of supporting base 20, for forwarding the particles atomized during crushing to a lateral outlet for further processing, in order to separate the recoverable minerals. The outlet 66 is preferably arranged at the same height as the fan rotor for effective removal of the crushed particles. The supporting base 20 is held on a supporting frame 28, and the feeder plate 30 for accommodating the bottom edge of the crushing chamber wall 12 during the working position portrayed in FIG. 1 forms the top of the supporting base 20. The supporting base 20, underneath feeder plate 30, features a housing 34 which accommodates the drives for the rotors 16, 18 and an exhaust duct. The corner areas of frame 28 of the supporting base 20 contain four hydraulic cylinders 36 which constitute the active parts of a lifting device. The hydraulic cylinders 36 are connected on their bottom sides to the frame 28 of the supporting base 20, and on their top sides to the horizontal support arms 40, which project radially from the crushing chamber wall 12. The four hydraulic cylinders 36, together with the support arms 40 and the electrical control not shown herein, constitute the lifting device of the crushing device 10.

During operation, the crushing chamber wall 12 is located in the working position portrayed in FIG. 1, relative to the supporting base 20, wherein the bottom edge 32 of the crushing chamber wall 12 rests on the feeder plate 30 of the supporting base 20, against which it preferably fits tightly to create a hermetic seal. This prevents any crushed material from escaping between the supporting base 20 and the crushing chamber wall 12 during operation of the crushing device. For maintenance of the elements in the crushing chamber 14, e.g. the rotors 16, 18 and the associated striking tools 22, 24, it is possible via the four hydraulic cylinders 36 to lift the crushing chamber wall 12 up into the maintenance position portrayed in FIG. 2, in which all striking tools 22, 24 of the two rotors 16, 18 are freely accessible as the bottom edge 32 of the crushing chamber wall 12 is in that position located vertically above the top-most striking tools 22. This position thereby allows excellent access both to the rotors 16, 18 and to the striking tools, thus permitting easy replacement of defective striking tools or easy maintenance of worn striking tools.

Figure 2:
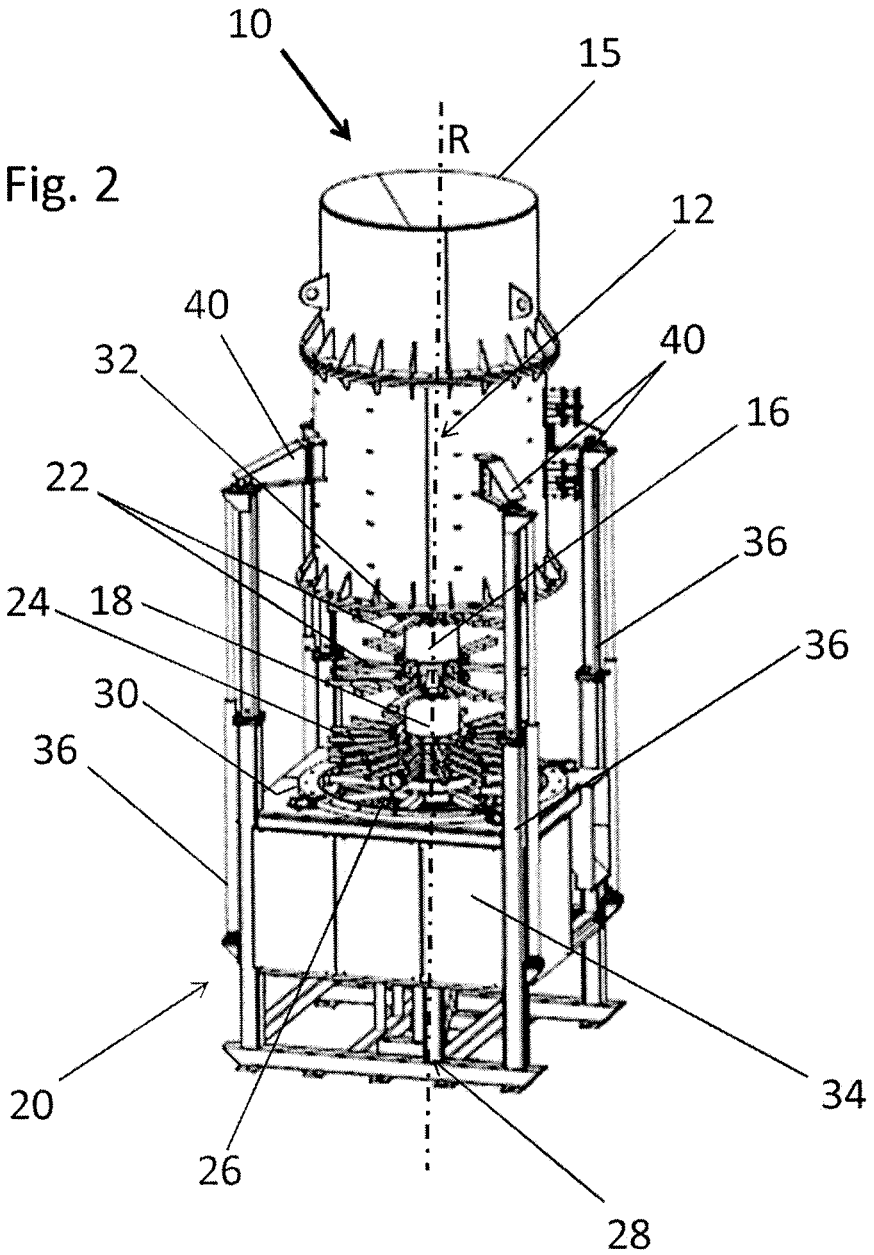
FIG. 2 shows a perspective view of the first embodiment of the invention with the lifting device in the maintenance position.
Figure 3:
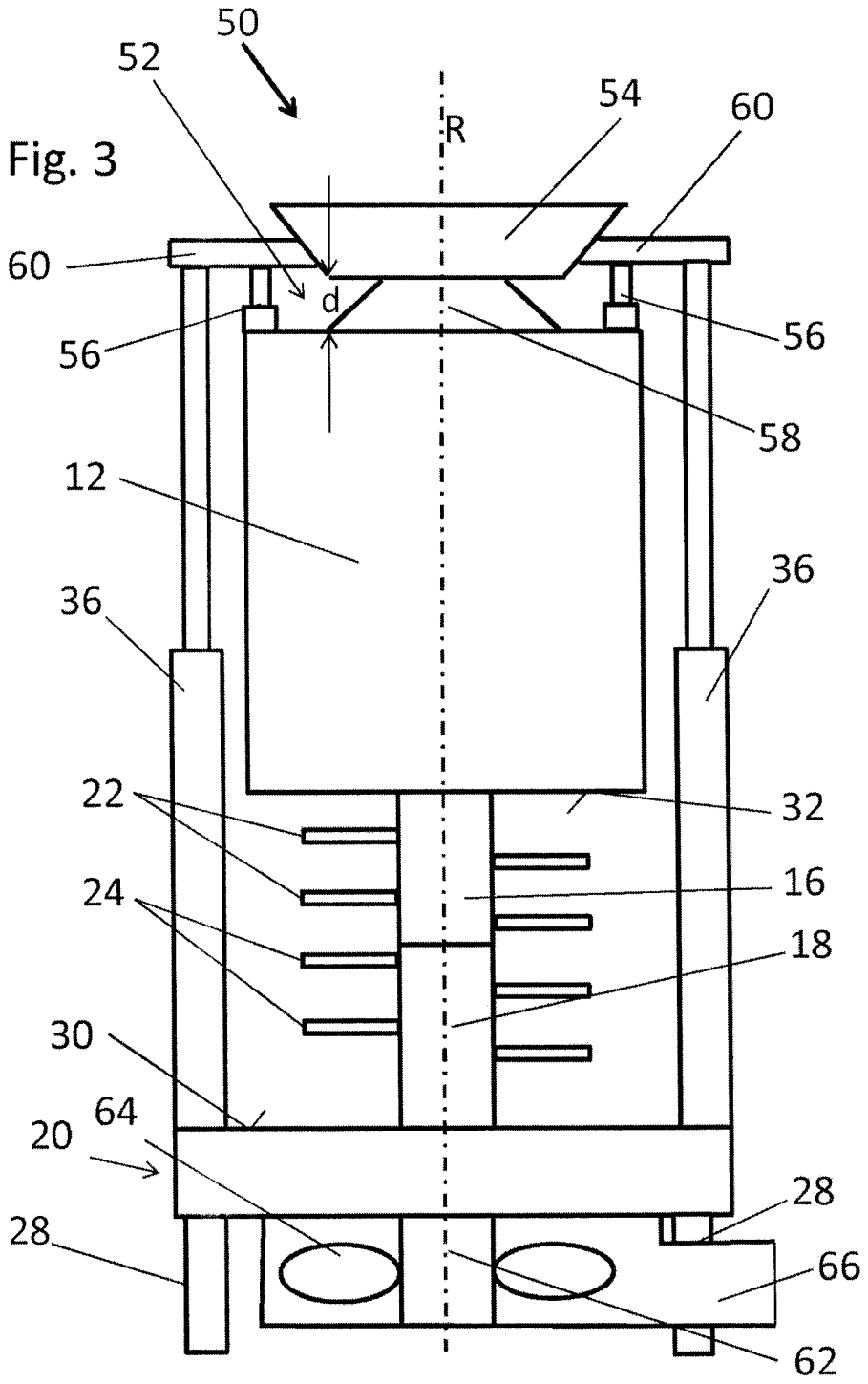
FIG. 3 shows a second embodiment of a crushing device where it is possible to also adjust the feed hopper's distance relative to the loading cone with the lifting device.

FIG. 3 shows a side view of a second embodiment of the invention which is largely identical to the embodiments shown in FIGS. 1 and 2, wherein identical or analog parts were labeled with the same reference signs. The crushing device 50 shown in FIG. 3 differs from the embodiment shown in FIGS. 1 and 2 in that the infeed side 52 of the crushing device 50 features a feed hopper 54 whose distance to a loading cone 58 can be variably adjusted by an adjusting device 56, and which loading cone 58 is either firmly attached to or attachable to the crushing chamber wall 12. The top of the adjusting device 56 is connected to horizontal mounting arms 60 which project radially from feed hopper 54. Activating the lifting device, i.e. the hydraulic cylinders 36, into the maintenance position portrayed will cause not only the crushing chamber 12 to be lifted, but also the feed hopper 54 and the loading cone 58. The size of the slot between the feed hopper and the loading cone 58 can be easily adjusted by releasing the adjusting device while the bottom edge 32 of the crushing chamber wall 30 is resting on the feeder plate 30 of the supporting base 20, in which case activating the lifting device 36 will lift only the feed hopper 54 towards the loading cone 58, which in turn is firmly attached to the crushing chamber wall 12.

After adjusting the infeed slot to the desired size by activating the lifting device, it is now time to set the adjusting device 56. At this point, the lifting device is lifted again to move the loading cone and the crushing chamber wall 12 together with the feed hopper 54, which makes it possible to raise the crushing chamber wall up into the maintenance position and to lower it down into the working position.

The embodiment 50 shown in FIG. 3, in addition to the two rotors 16, 18 and the associated striking tools 22, 24, also shows a fan rotor 62 with fan rotor blades 64 arranged in an area of the supporting base 20, which are an integral element of an air flow device which, during operation of the crushing device portrayed in FIG. 1, ensures a defined air flow to the crushing chamber and the removal notably of dust particles into an outlet 66 arranged next to it. It is possible to install a collecting container for the crushed goods or a processing plant such as e.g. a cyclone directly downstream of outlet 66.

LIST OF REFERENCE SIGNS

10 Crushing device (first embodiment)
12 Crushing chamber wall
14 Crushing chamber
15 Infeed side
16 Top rotor
18 Bottom rotor
20 Supporting base
22 Top striking tools
24 Bottom striking tools
26 Fan rotor
28 Frame
30 Feeder plate
32 Bottom edge of the crushing chamber wall
34 Housing
36 Hydraulic cylinder
40 Support arms
50 Crushing device (second embodiment)
52 Infeed side
54 Feed hopper
56 Adjusting device
58 Loading cone
60 Mounting arms
62 Fan rotor
64 Fan rotor blades
66 Outlet

The invention claimed is:

1. A comminution device for the mechanical crushing of materials that has a working position and a maintenance position, the comminution device comprising:

at least one rotor rotating around a vertical rotation axis (R) located in a crushing chamber having an upper end and a bottom end, the crushing chamber being supported by a supporting base, whereby the at least one rotor is held at the bottom end of the crushing chamber in a fixed stationary position in relation to the supporting base, the crushing chamber has an inlet at the upper end for infeed of materials and an outlet at the bottom end for outfeed of materials, the crushing chamber includes a plurality of striking tools which project radially into the crushing chamber and a crushing chamber wall that encloses the crushing chamber, the crushing chamber wall being movable between a working position wherein a bottom edge of the crushing chamber wall rests on a feeder plate of the supporting base against which the bottom edge fits tightly to create a hermetic seal and a maintenance position wherein the bottom edge of the crushing chamber wall is lifted vertically along the vertical rotation axis (R) above the supporting base such that the bottom edge of the crushing chamber wall is located vertically above a top of all of the plurality of striking tools and at least one rotor to expose all of the plurality of striking tools and the at least one rotor, a lifting device is secured between the supporting base and the crushing chamber wall and selectively moves the crushing chamber wall between the working position and the maintenance position, the lifting device is connected to a side of the crushing chamber wall by a plurality of horizontal support arms which project radially from and are attached to the crushing chamber wall, the lifting device is height-adjustable relative to the supporting base so as to lift the crushing chamber wall between the working position and the maintenance position.

2. The comminution device according to claim 1, wherein the lifting device comprises at least one hydraulic cylinder.

3. The comminution device according to claim 1, wherein the lifting device has between two and four vertically arranged, parallel hydraulic cylinders.

4. The comminution device according to claim 3, wherein the between two and four vertically arranged, hydraulic cylinders are arranged equidistantly around an axis of the crushing device.

5. The comminution device according to claim 1, wherein a bottom side of the lifting device is connected to the supporting base.

6. The comminution device according to claim 1, wherein an electrical circuit breaker is in contact with the supporting base or partially connected to the supporting base, or in contact with a circular cylindrical and/or conically flared crushing chamber wall or partially connected to the circular cylindrical and/or conically flared crushing chamber wall.

7. The comminution device according to claim 1, wherein a circular cylindrical and/or conically flared crushing chamber wall is a cylinder wall with a circular or polygonal footprint.

8. The comminution device according to claim 1, wherein the crushing chamber is arranged vertically, with the infeed side on top and the outlet side on the bottom.

9. The comminution device according to claim 1, further comprising a loading cone arranged at the infeed side in connection with the crushing chamber, the loading cone is moved by the lifting device either separately and/or in conjunction with a circular cylindrical and/or conically flared crushing chamber wall.

10. The comminution device according to claim 9, further comprising a feed hopper attached to the infeed side of the crushing chamber wall, and that distance between the feed hopper and the loading cone can be adjusted by an adjusting device via activation of the lifting device.

11. The comminution device according to claim 1, further comprising an airflow device for conveying a mix of air and particles generated in the crushing chamber, the airflow device is arranged in connection with the crushing chamber and comprises at least one fan rotor arranged coaxially to the axis of the crushing chamber, the fan rotor is powered by a fan drive enabling the at least one fan rotor to rotate independently of the at least one rotor of the crushing chamber, whereby the at least one fan rotor is located below the bottom edge of a circular cylindrical and/or conically flared crushing chamber wall when the circular cylindrical and/or conically flared crushing chamber wall is raised up into a maintenance position of the lifting device.

12. The comminution device according to claim 11, wherein the fan rotor is located at the supporting base at a height of an outlet.

13. The comminution device according to claim 11, wherein the bottom edge of the crushing chamber wall while in the maintenance position of the lifting device is lifted above a fastening point of the plurality of striking tools.

14. The comminution device according to claim 1, wherein the bottom edge of a circular cylindrical and/or conically flared crushing chamber wall; while in a working position of the lifting device, is in contact with the supporting base.

15. The comminution device according to claim 1, wherein the crushing chamber has at least two successive sections arranged in an axial direction, whereby the at least one rotor is arranged coaxially to the crushing chamber, and whereby each rotor of the at least one rotor at least during operation comprises the plurality of striking tools.

* * * * *